US005275533A

United States Patent [19]

Kapich

[11] Patent Number: 5,275,533

[45] Date of Patent: * Jan. 4, 1994

[54] QUIET COMPRESSED AIR TURBINE FAN

[76] Inventor: Davorin D. Kapich, 3111 Serrano Dr., Carlsbad, Calif. 92009

[ * ] Notice: The portion of the term of this patent subsequent to Feb. 7, 2008 has been disclaimed.

[21] Appl. No.: 750,272

[22] Filed: Aug. 27, 1991

[51] Int. Cl.[5] ..... F01D 9/02

[52] U.S. Cl. ..... 415/202; 415/912; 417/408

[58] Field of Search ..... 415/202, 904; 417/406–409

[56] References Cited

U.S. PATENT DOCUMENTS 2,219,937 10/1940 Ponomareff ..... 417/408

3,607,779 9/1971 King ..... 261/24

4,066,381 1/1978 Earnest ..... 415/202

4,469,536 11/1990 Allen ..... 415/119

5,013,214 5/1991 Kapich ..... 415/202

*Primary Examiner*—John T. Kwon

*Attorney, Agent, or Firm*—John R. Ross

[57] ABSTRACT

A compressed air turbine driven fan having an axial blade fan impeller driven by a partial admission radial inflow air turbine, with both the fan blades and the turbine blades mounted on the hub rim of a single fan-turbine wheel. The turbine exhaust is discharged into a cavity surrounding the shaft of the fan-turbine wheel. In a preferred embodiment, a sound surpressing muffler made of plates having air passage offset from each other is provided with the cavity. Turbine exhaust air exists through the passages to mix with the fan flow.

10 Claims, 1 Drawing Sheet

QUIET COMPRESSED AIR TURBINE FAN

This invention relates to fans and in particular to compressed air turbine driven fans.

BACKGROUND OF THE INVENTION

Removal of smoke or other hazardous gases from enclosed spaces such as refinery tanks, tanker ships, commercial and naval vessels and mine shafts, require high volume, high head fans. These fans may be driven by electricity, water power of compressed air. There are some significant advantages in using compressed air. However, existing high power compressed fans are very noisy. This is because in the typical compressed air fan the exhaust air out of the turbine is moving at supersonic speed. Very often the personnel that are working in close proximity of such fans are exposed to a high pitch noise generated by the exhausting air. Such high pitch noise is usually uncomfortable to the persons exposed to it. Occupational safety laws, generally limit the time the worker could be exposed to a high level noise.

It is an objective of the present invention to provide a compressed air turbine driven fan which operates at substantially lower noise level than the noise generated by state of the art air turbine driven fans.

SUMMARY OF THE INVENTION

The present invention provides a compressed air turbine driven fan having an axial blade fan impeller driven by a partial admission radial inflow air turbine, with both the fan blades and the turbine blades mounted on the hub rim of a single fan-turbine wheel. The turbine exhaust is discharged into a cavity surrounding the shaft of the fan-turbine wheel. In a preferred embodiment, a sound surpressing muffler made of plates having air passage offset from each other is provided within the cavity. Turbine exhaust air exits through the passages to mix with the fan flow.

DESCRIPTION OF THE PREFERRED EMBODIMENT

Figure 1:
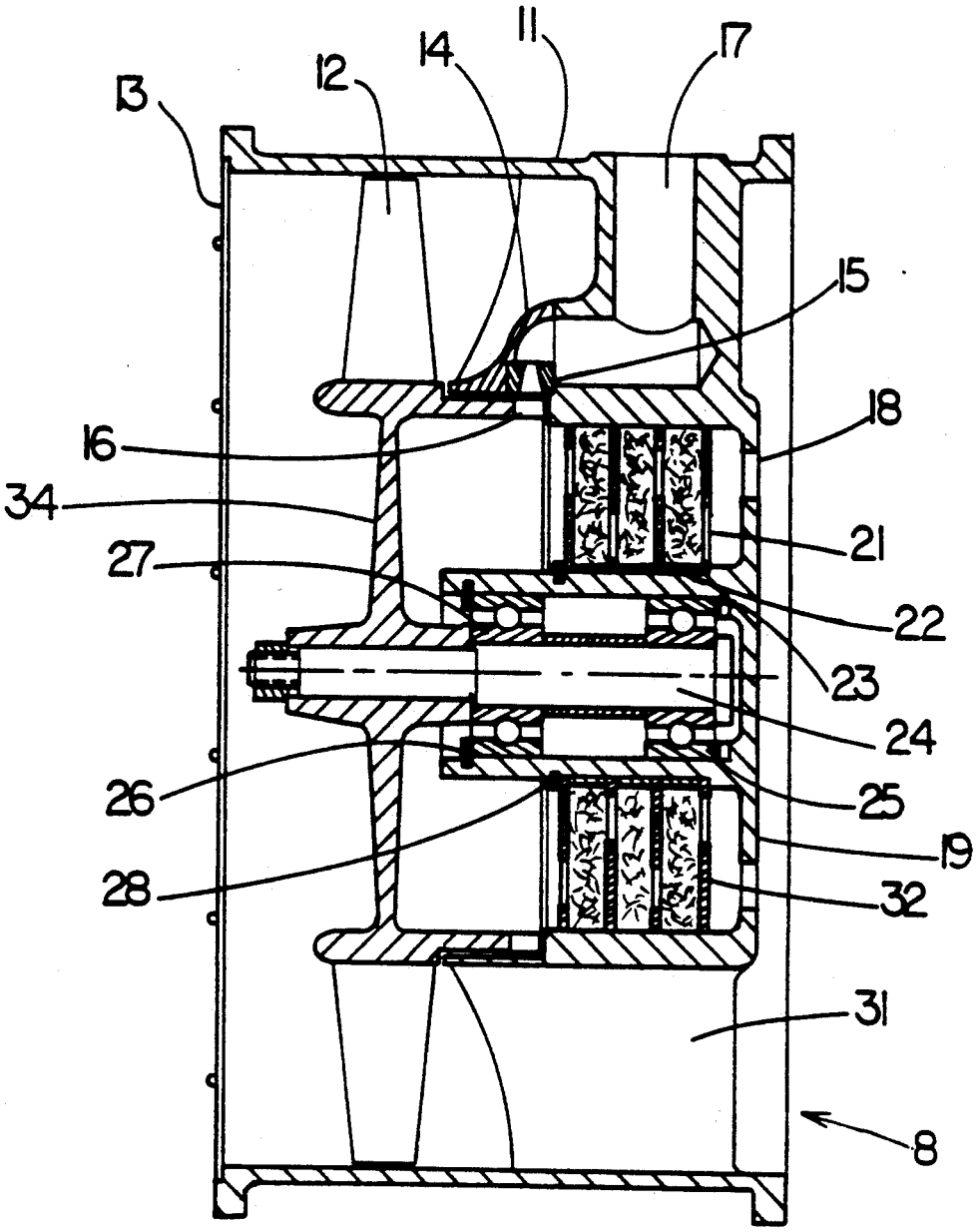
FIG. 1 is a sectional elevation in an axial plane of a fan incorporating the present invention.

A preferred embodiment of a novel compressed air turbine driven fan, designed to provide 6,000 cubic feet per minute of air with 10 inches water gauge pressure rise while being driven by a compressed air turbine producing 12 horsepower and consuming 250 standard cubic feet per minute of air compressed to a pressure of 75 PSIG, is shown in FIG. 1. An integral fan-turbine wheel is designed to operate at 8344 RPM and has a fan tip diameter of 14 inch and turbine blades mounted on a cylindrical rim extending from the fan blades hub. Turbine air flow is discharged through a cavity located within the fan housing.

With particular reference to FIG. 1, a compressed air turbine driven fan incorporating the principle of the present invention is generally indicated by the reference numeral 8. Such fan 8 includes cylindrical fan housing 11 which is solidly connected to the fan center body 19 via 10 stator vanes 31. The fan center body 19 provides support to turbine nozzle block 15, which contains one or more air nozzle passages. In the present embodiment there are two air nozzle passages spaced 10 degrees apart. (This spacing is not shown on the figure.) The nozzle cover 14 is solidly attached to the fan centerbody 19 and seals the compressed air upstream of the nozzle block 15 from the atmospheric air generally present in the fan housing 11. The compressed air is fed into the air nozzle block 15 through the turbine inlet passage 17. The fan center body 19 contains one or more muffler plates 32 (in this case, four) incorporating air flow passages 21 positioned in alternative location so that with the multiple muffler plates 32, the passages 21 will not overlap in a straight line from one plate 32 to other plates 32. This configuration prevents the sound waves from propagating in a straight line and forces the sound waves to be reflected and substantially dissipated between the muffler plates 32. The muffler plates 32 are spaced in between sleeves 22 and are axially contained by lock spring 28. The centerbody 19 incorporates prelubricated antifriction bearings 25 and 27, lock spring 26 and spring washer 23. Said bearings provide for rotatable radial and axial support to shaft 24 which at its front end supports a firmly attached fan-turbine wheel 34. Fan blades 12 are attached to wheel 34. Also firmly attached to wheel 34 are turbine blades 16 mounted at the down stream end of the rim located approximately at the base diameter of the fan blades 12. In this particular embodiment, the fan blades 12, the turbine blades and the fan-turbine wheel are all cast of aluminum as a single unit. (This feature greatly reduces the manufacturing cost of the fan.) Spring washer 23 provides for an axial load to bearings 25 and 27, thus providing for a more central shaft location at all operating conditions.

My 12 horsepower design comprizes 16 fan (or impeller) blades 12 utilizing standard NACA 65 series airfoils mounted in accordance with standard design practice. The fan air flow enters into the fan through the protective screen 13 into the impeller blades 12 which pump the fan air flow further through the stator vanes 31 and on the outside of center body 19, around the nozzle cover 14 and around the walls of the turbine inlet passage 17 and further to exit from the fan housing 11.

Figure 2:
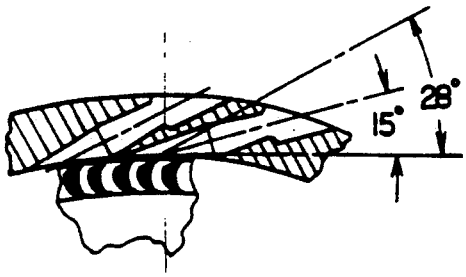
FIG. 2 is a sectional view of a nozzle block.

The compressed air is supplied to the air turbine at the pressure ranging typically from 60 to 110 PSIG into the turbine inlet passage 17. The compressed air flows further into two air nozzle passages located in the nozzle block 15 where it expands down to a pressure slightly above the atmospheric pressure, thus converting the pressure energy into the kinetic energy in accordance with standard impulse turbine principles of operation. One passage is shown in FIG. 1 the other passage also in the same nozzle block 15 offset by 10 degrees is not shown. The high velocity air passes further through a series of turbine blades 16 which are designed in accordance with standard impulse turbine design practice and are able to accomodate a substantially radial inflow type turbine design. In this embodiment, the air nozzle passages located in the nozzle block 15 are at an angle of 10 to 30 degrees from the tangent to the circumference of the circle described by the base turbine blades 16. The leading and the trailing edges of the turbine blades 16 are designed typically with angles of 20 to 35 degrees causing the air flow to turn inside the turbine blades 16 by 110 to 140 degrees. In my design for 12 horsepower I have two nozzles of 0.375 inch diameter each. As indicated in FIG. 2, the nozzle angles are 15 degrees off tangent and the blade angles are 28 degrees off tangent causing the air flow inside the turbine blades 16 to turn by about 124 degrees.

The air flow existing the turbine blades 16 exhausts into a cavity behind wheel 34 of the impeller 12 where almost all of the turbine air flow is forced to exist through the passage 21 incorporated into the muffler plates 32. A very small portion of the turbine air leakes through the axial gap between the cylindrical rim supporting turbine blades 16 and the adjecent wall of the fan housing 11. This leak flow is very minimal because of relatively low pressure differential being created by the flow restriction of the muffler plates 32. As described earlier, the orientation of the muffler plates 32 is such that the flow passages 21 and 18 cannot line up in a straight line thus forcing the turbine discharge flow to change direction several times and also causing substantial dissipation of the sound waves created by the action of the high velocity air flow expanding through nozzle 15 and turbine blades 16. If increased sound attenuation is required, the spaces between muffler plates 32 can be filled with materials such as steel wool or other sound absorbing materials that are permiable to the air flow.

It should be understood, that the specific form of the invention illustrated and described herein is intended to be representative only, as certain changes may be made therein without departing from the clear teachings of the disclosure. For example, for very high speed fans it may be appropriate to cast the blade-wheel unit of titanium instead of aluminum. Accordingly, reference should be made to the following appended claims in determining the full scope of the invention.

I claim:

1. A compressed air turbine driven fan comprising:

(a) a fan housing;

(b) at least two shaft bearings;

(c) a shaft supported by said at least two shaft bearings;

(d) a fan-turbine wheel mounted on said shaft;

(e) a generally cylindrically shaped center body means contained within said housing for supporting said at least two bearings, said center body means defining at least in part a turbine exhaust cavity having an entrance and an exit, and said center body and said housing defining a generally annularly shaped passage through said fan;

(f) a plurality of fan blades positioned on said fan-turbine wheel and extending almost to the outside diameter of said generally annularly shaped passage;

(g) a plurality of turbine blades positioned on said fan-turbine wheel;

(h) at least one turbine nozzle means for directing compressed air against said turbine blades and into said entrance of said exhaust cavity.

2. A fan as in claim 1 and further comprising a sound suppression means located within said cavity.

3. A fan as in claim 2 wherein said sound suppression means comprise a plurality of annular plates having openings spaced to prevent direct propagation of sound waves through the cavity.

4. A fan as in claim 3 wherein said sound suppression means further comprise steel wool for additional sound suppression.

5. A fan as in claim 1 wherein said turbine means comprise a generally cylindrically or connically shaped nozzle defining a centerline, wherein the circumference of said center body defines a tangent where said centerline intersects said circumference and wherein the angle formed by said centerline and said tangent is between 10 degrees and 30 degrees.

6. A fan as in claim 5 wherein said turbine blades are curved and positioned on said fan-turbine wheel so as to form an angle of between 20 degrees and 35 degrees with said tangent at the inlet edge of said blades and the same angle in the opposite direction at the discharge edge of said blades so as to cause the flow to turn between 110 and 140 degrees.

7. A fan as in claim 6 wherein said angle formed by said centerline and said tangent is about 15 degrees and said angle formed by the inlet edge of said blades and said tangent is about 28 degrees.

8. A fan as in claim 1 wherein said turbine blades are mounted on said fan-turbine wheel near the base of said fan blades.

9. A fan as in claim 1 wherein said fan blades, said turbine baldes are cast as a single unit.

10. A fan as in claim 9 wherein said single unit is aluminum.

* * * * *